US007665614B2

(12) United States Patent
Malmberg

(10) Patent No.: US 7,665,614 B2
(45) Date of Patent: Feb. 23, 2010

(54) SCREENING ARRANGEMENT

(75) Inventor: Mats Malmberg, Rydsgård (SE)

(73) Assignee: Sandvik Intellectual Property AB, Sandviken (SE)

( * ) Notice: Subject to any disclaimer, the term of this patent is extended or adjusted under 35 U.S.C. 154(b) by 153 days.

(21) Appl. No.: 11/636,712

(22) Filed: Dec. 11, 2006

(65) Prior Publication Data

US 2007/0144945 A1 Jun. 28, 2007

(30) Foreign Application Priority Data

Dec. 13, 2005 (SE) ..... 0502734

(51) Int. Cl.
*B07B 1/04* (2006.01)
*B07B 1/28* (2006.01)

(52) U.S. Cl. ..... 209/264; 209/44.2; 209/243; 209/314

(58) Field of Classification Search ..... 209/311, 209/314, 315, 264, 266
See application file for complete search history.

(56) References Cited

U.S. PATENT DOCUMENTS

| | | | | |
|---|---|---|---|---|
| 3,804,246 | A * | 4/1974 | Ljungqvist | 209/264 |
| 4,221,306 | A | 9/1980 | Althoff | |
| 4,466,542 | A * | 8/1984 | Oetiker et al. | 209/44.2 |
| 4,576,713 | A * | 3/1986 | Melin | 209/254 |
| 4,652,362 | A * | 3/1987 | Mueller | 209/44.2 |
| 5,232,098 | A | 8/1993 | St. Pierre et al. | |
| 5,244,098 | A * | 9/1993 | Hadden | 209/243 |
| 5,301,811 | A * | 4/1994 | Mueller | 209/44.2 |
| 5,494,173 | A | 2/1996 | Deister et al. | |
| 5,614,094 | A * | 3/1997 | Deister et al. | 210/388 |
| 5,749,471 | A * | 5/1998 | Andersson | 209/314 |
| 6,079,568 | A | 6/2000 | Loshe | |
| 2003/0192819 | A1 | 10/2003 | Casey et al. | |

FOREIGN PATENT DOCUMENTS

| | | | |
|---|---|---|---|
| GB | 2 247 850 | A | 3/1992 |
| JP | 10226409 | A | 8/1998 |
| WO | 2005/077551 | A1 | 8/2005 |

OTHER PUBLICATIONS

Database WPI, Week 199844, Derwent Publications Ltd., London, GB; AN 1998-514874, abstract & JP 10226409 A (Shinko Electronic Co LTD) Aug. 25, 1998.

* cited by examiner

*Primary Examiner*—Patrick H Mackey
*Assistant Examiner*—Terrell H Matthews
(74) *Attorney, Agent, or Firm*—Drinker Biddle & Reath LLP

(57) ABSTRACT

A screening arrangement in a vibrating screen for screening of material, such as crushed stone, gravel or the like, the screening arrangement having one or more screening decks placed at different heights and provided with directing means, where the directing means are provided on the underside of at least one upper screening deck to direct the screened material upstream onto a screening deck located below the at least one upper screening deck.

23 Claims, 8 Drawing Sheets

SCREENING ARRANGEMENT

RELATED APPLICATION DATA

This application is based on and claims priority under 37 U.S.C. §119 to Swedish Application No. 0502734-7, filed Dec. 13, 2005, the entire contents of which are incorporated herein by reference.

FIELD OF THE DISCLOSURE

The present disclosure relates to a screening arrangement in a vibrating screen for screening of material, such as crushed stone, gravel or the like, the screening arrangement being provided with directing means.

BACKGROUND

In the discussion that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

In mining and stone industries, it is in many cases important to fractionate crushed stone and gravel into fractions of stones with different sizes. In most cases, fractionating or screening is done by supplying an unfractionated stream of crushed stone or gravel to a vibrating screen provided with a screening deck including screening holes for allowing stones smaller than the screening holes to pass through the holes.

In present screening arrangements the efficiency of the screening on each screening deck in the screening arrangement is affected by the length of the traveling path of the material to be screened on each screening deck. As the material passes through the holes of one screening deck, gravity and the inclination of the screening deck together make the material fall onto the below-located screening deck further down on that below-located screening deck, making the traveling path on the below-located screening deck too short for the material to be screened properly.

To increase the efficiency of the screening the screening decks have been longer than in the previous screening arrangements providing a longer traveling path on each deck. Another method of improving the efficiency has been to arrange the feeding box, which supplies the screening arrangement with the material to be screened, to be located outside the screening arrangement, see e.g. FIG. 6.

However, many application locations have limited space, which is why the lengthening of the screening deck or the external feeding box are undesired solutions.

SUMMARY

The object with the presently disclosed devices and methods is to provide a screening arrangement that improves the flow of material on the screening arrangement so that an improved screening result is achieved. This is accomplished with a screening arrangement in a vibrating screen for screening of material, such as crushed stone, gravel or the like having one or more screening decks placed at different heights and provided with directing means, where the directing means are provided on the underside of at least one upper screening deck to direct the screened material upstream onto a screening deck located below the at least one upper screening deck.

Further aspects and embodiments are defined by the features of the dependent claims.

An exemplary embodiment of a screening arrangement in a vibrating screen for screening of material comprises one or more screening decks placed at different heights and directing means, wherein the directing means are provided on an underside of at least one upper screening deck to direct screened material upstream onto a screening deck located below the at least one upper screening deck.

BRIEF DESCRIPTION OF THE DRAWING

The following detailed description of preferred embodiments can be read in connection with the accompanying drawings in which like numerals designate like elements and in which.

DETAILED DESCRIPTION

Figure 1:
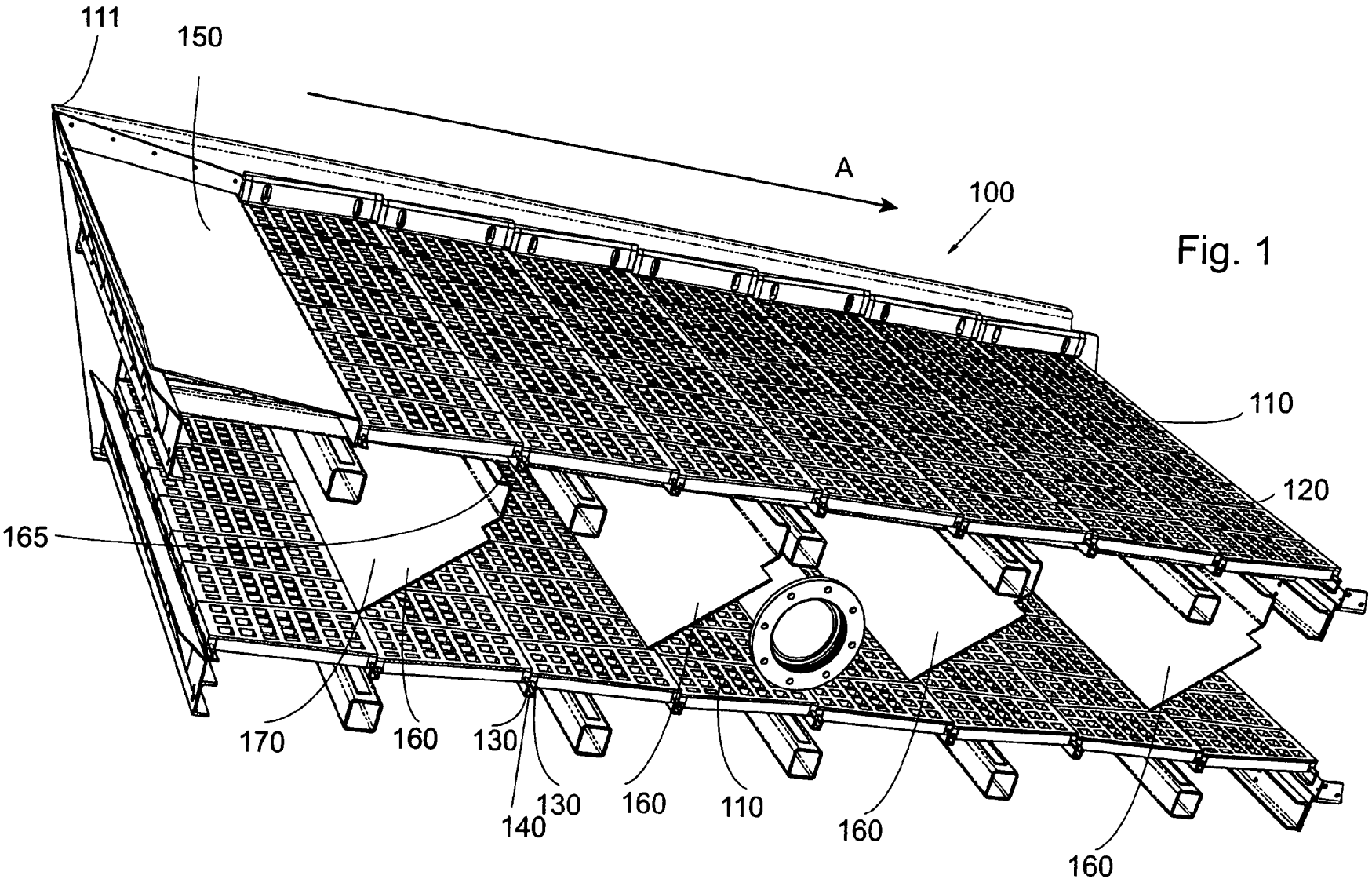
FIG. 1 is a schematic perspective assembly view of a screening arrangement provided with directing means.

FIG. 1 schematically shows a screening arrangement 100 for a vibrating screen for screening of crushed stones, gravel or the like. A longitudinal direction of the vibrating screen is indicated with an arrow A in FIG. 1. The longitudinal direction A of the screening arrangement 100 is also the traveling directions of the material, i.e. stones or gravel, on the vibrating screen.

Figure 2:
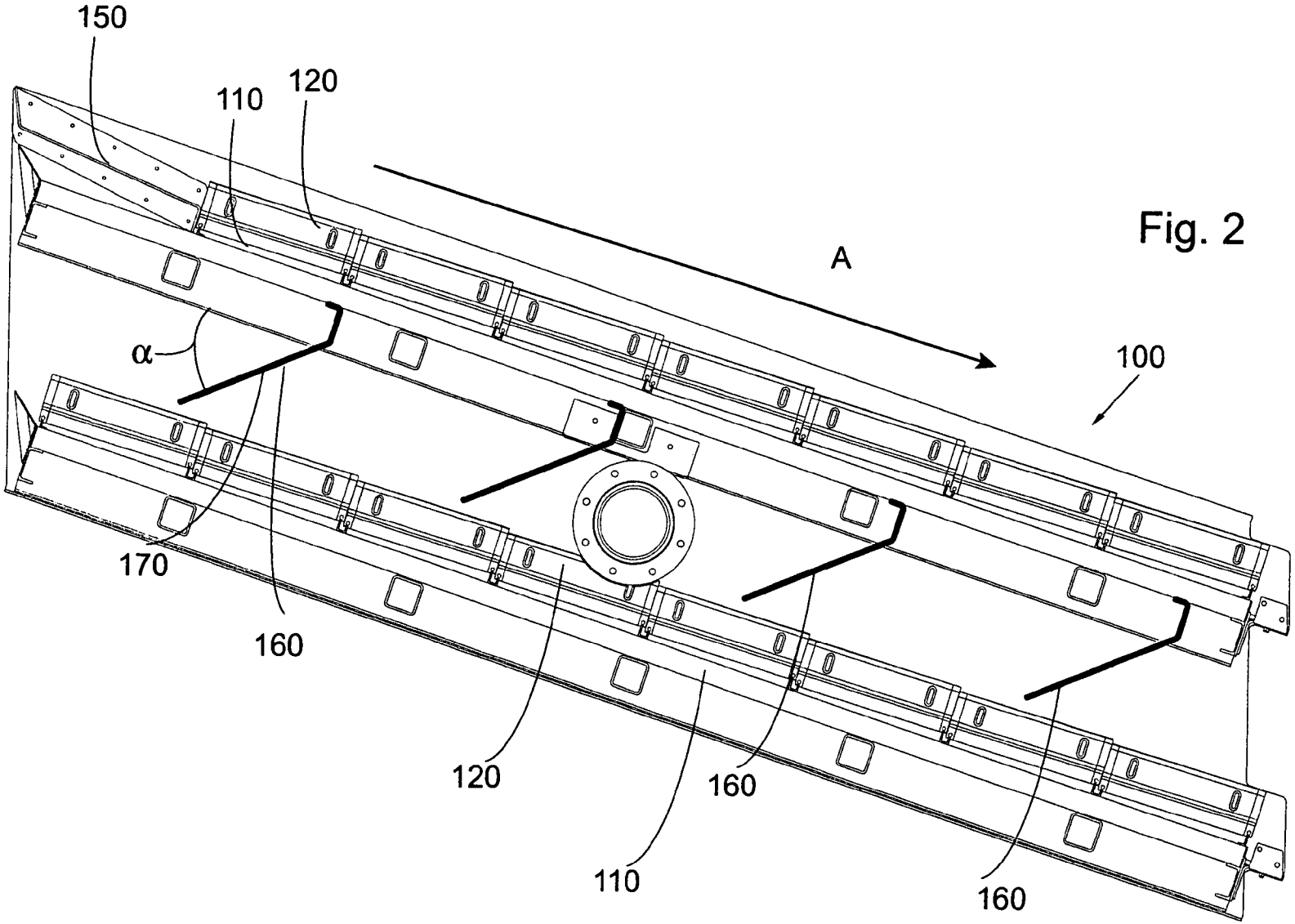
FIG. 2 is a side view of the screening arrangement provided with the directing means of FIG. 1.

The screening arrangement 100 of FIGS. 1 and 2 comprises two screening decks 110, each screening deck 110 comprising a number of rows of screening elements 120. In each row alternately orientated screening elements 120 are arranged. The screening elements 120 have an identical trapezoid shape with two inclined sides, a narrow end and a wide end. The screening elements 120 are normally alternately placed so that each second screening element 120 is oriented with the wide end in the traveling direction A of the screened material and the screening elements 120 in-between are oriented with the narrow ends in the traveling direction A of the screened material. Thus, a number of alternately placed screening elements 120 forms the screening deck 110. This kind of screening elements 120 is previously shown in the PCT-application WO-A1-2005077551.

The rows of screen elements 120 are arranged on elongated stanchions 130 arranged on a transversally arranged carrier 140, where the carrier 140 extends between the side walls of the screening arrangement 100. The stanchions 130 of each carrier 140 have different heights so that two rows of screening elements 120 being attached to the same carrier 140 are arranged with difference in height between the rows so that "steps" are formed on the screening deck 110.

In the upper or feeding end 111 of the upper screening deck 110 a feeding box 150 is arranged. Compared with the screening arrangement of FIG. 6 the feeding box 150 has been arranged inside the space occupied by the screening arrangement 100. The material to be screened enters the screening arrangement 100 in the feeding end 111 of the screening deck 110 into the feeding box 150.

On the underside of every second row of screening elements 120 guiding or directing means 160 are arranged. The guiding or directing means 160 comprise a directing plate 170, which extends obliquely relative to and towards the longitudinal direction of the screening deck 110 from a fastening point 165 close to a lower end of a row of the screening elements 120. An angle $\alpha$ is formed between the longitudinal direction of the screening deck 110 and the extension of the directing plate 170. In FIG. 2 the angle $\alpha$ is about 40 degrees, but the angle $\alpha$ may vary between 20 and 80 degrees depending on the inclination of the screening arrangement 100 and the material of the directing plate 170.

A greater inclination of the screening arrangement 100 requires a greater angle $\alpha$, and a smaller inclination of the screening arrangement 100, enables a smaller angle $\alpha$. The directing plate 170 and the directing means 160 may be arranged on a shaft (not shown) that extends between the side walls of the screening arrangement 100, where the shaft can be provided with a handle or an electric motor to pivot the directing plate 170 and the directing means 160, e.g. during maintenance of the screening arrangement 100. The shaft can also be provided with a graduated arc to easily adjust the angel of the directing plate 170 and the directing means 160.

If the material of directing plate 170 has a low surface friction, such as ceramics, the angle $\alpha$ can be smaller since material that falls onto the directing plate 170 easily moves on the directing plate 170 and further down to the screening deck located below the directing plate 170. But if the material of directing plate 170 has high surface friction, such as rubber, the angle $\alpha$ must be greater, otherwise material that falls onto the directing plate 170 will stay on the directing plate 170 and piles of material will be built up on the directing plate 170 and the screening arrangement stops to function since material will not be pass through the holes of the screening deck 110.

The directing means 160 and the directing plate 170 can be made of steel, ceramics, polymer materials or the combinations thereof. The directing plate 170 can e.g. comprise a core member of steel and a coating layer of rubber, where the coating layer of rubber makes the directing plate 170 wear resistant. The directing plate 170 can also be made entirely of polymer materials of different hardness or rigidity. Another possible solution is a directing plate 170 comprising a metal frame having a surface of a flexible material stretching inside the frame.

Figure 3:
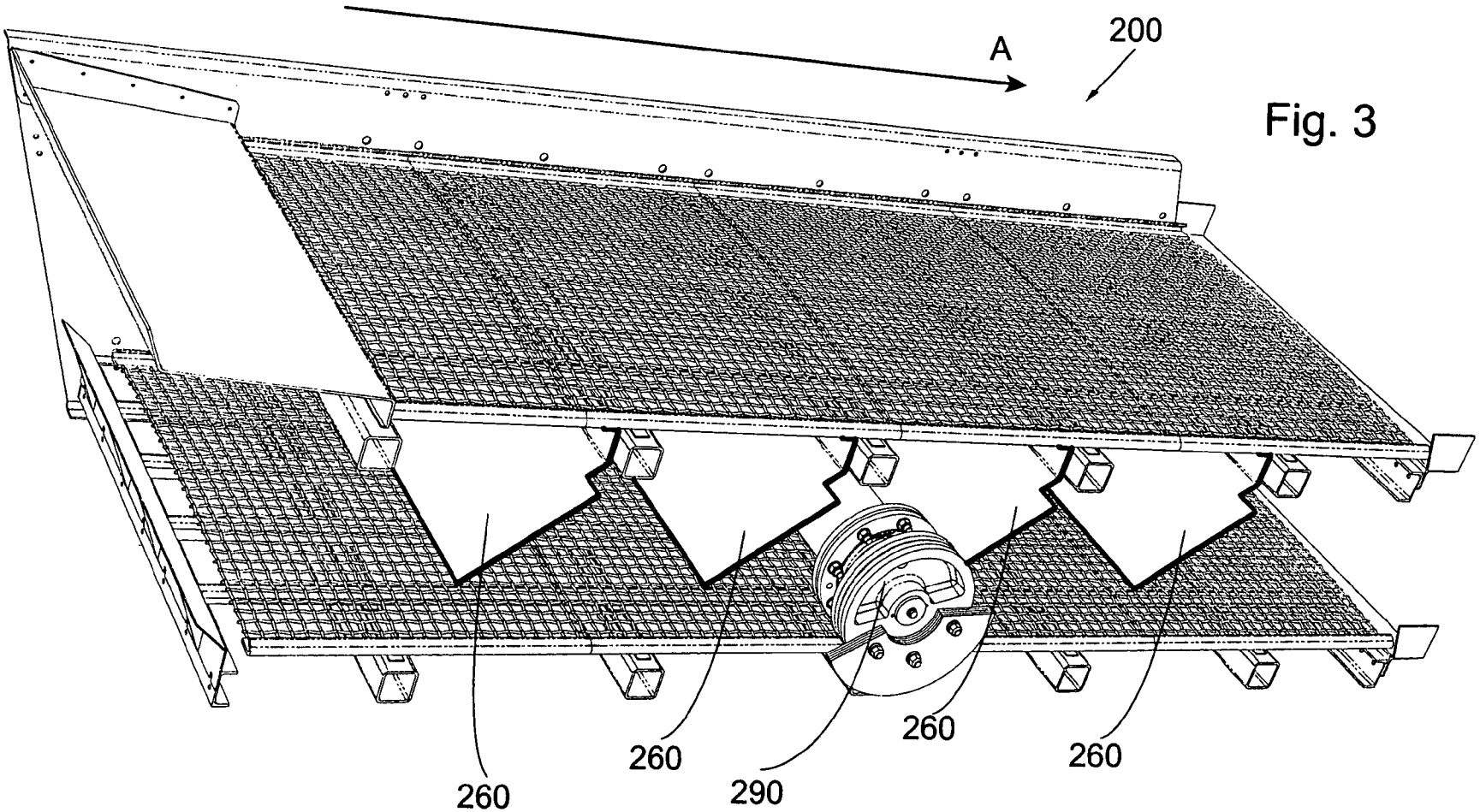
FIG. 3 is a schematic perspective assembly view of an alternative screening arrangement provided with directing means.

In FIG. 3 screening elements from FIG. 1 have been replaced by a screening media. The screening media can either be a cross-tensioned or a longitudinally tensioned screening media that is arranged in a vibrating screen by means of fastening arrangements in each end of the screening media that fasten the screening media to the walls or the ends, respectively, of the vibrating screen. In the screening arrangement 200 of FIG. 3 the directing means 260 are arranged similar to the screening arrangement of FIG. 1 and FIG. 2. Other variants of screening arrangements are also possible, like e.g. a modular system where each module comprise a flexible screening cloth surrounded by a metal frame.

Figure 4:
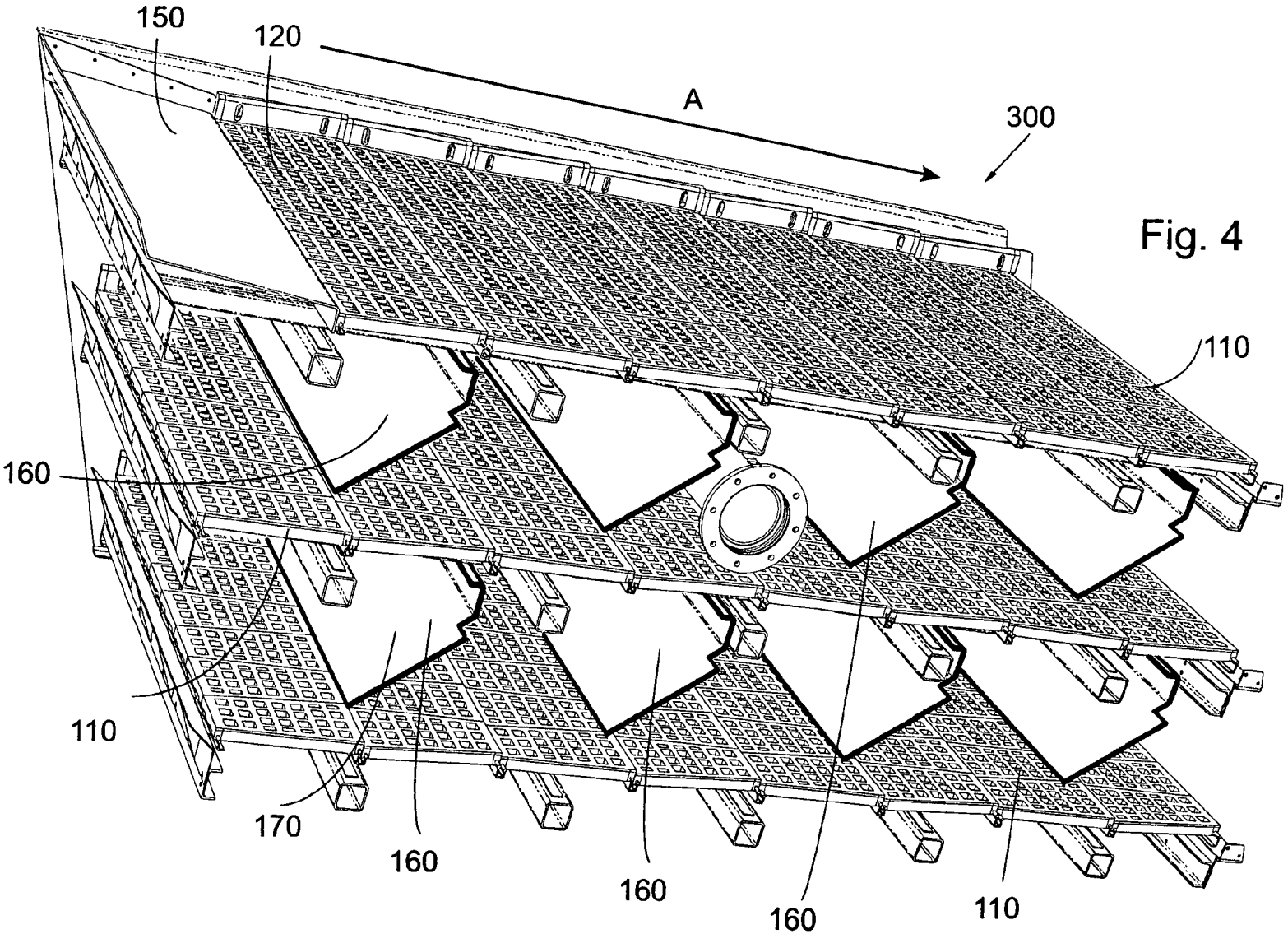
FIG. 4 is a schematic perspective assembly view of a screening arrangement provided with directing means, the screening arrangement comprising three screening decks.
Figure 5:
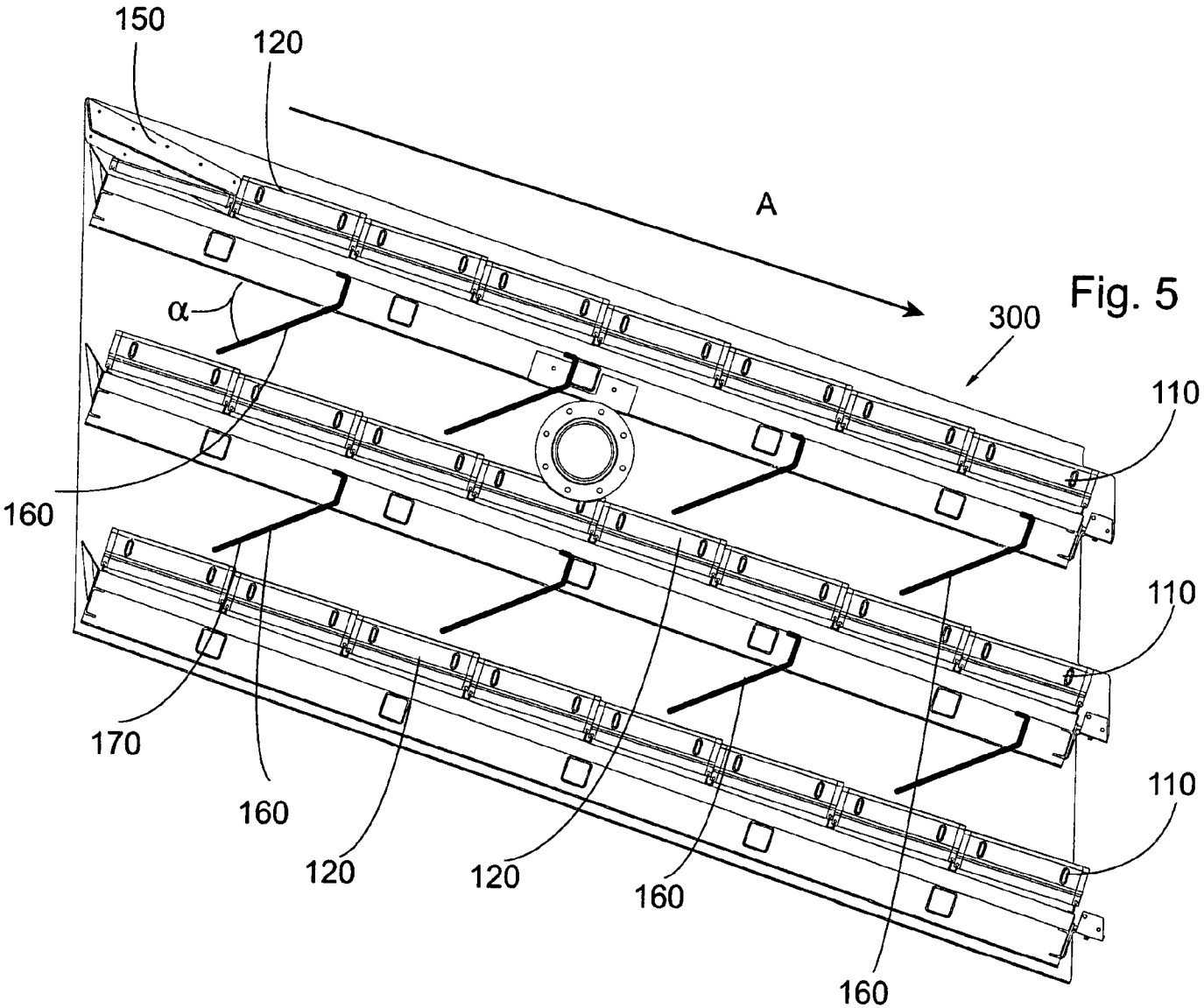
FIG. 5 is a side view of the screening arrangement provided with directing means of FIG. 4.

In FIGS. 4 and 5 the screening arrangement 300 comprises three screening decks 110, but is otherwise similar to the screening arrangement of FIG. 1 and FIG. 2. It is also possible to arrange the directing means on a screening arrangement having four or more screenings decks.

Figure 6:
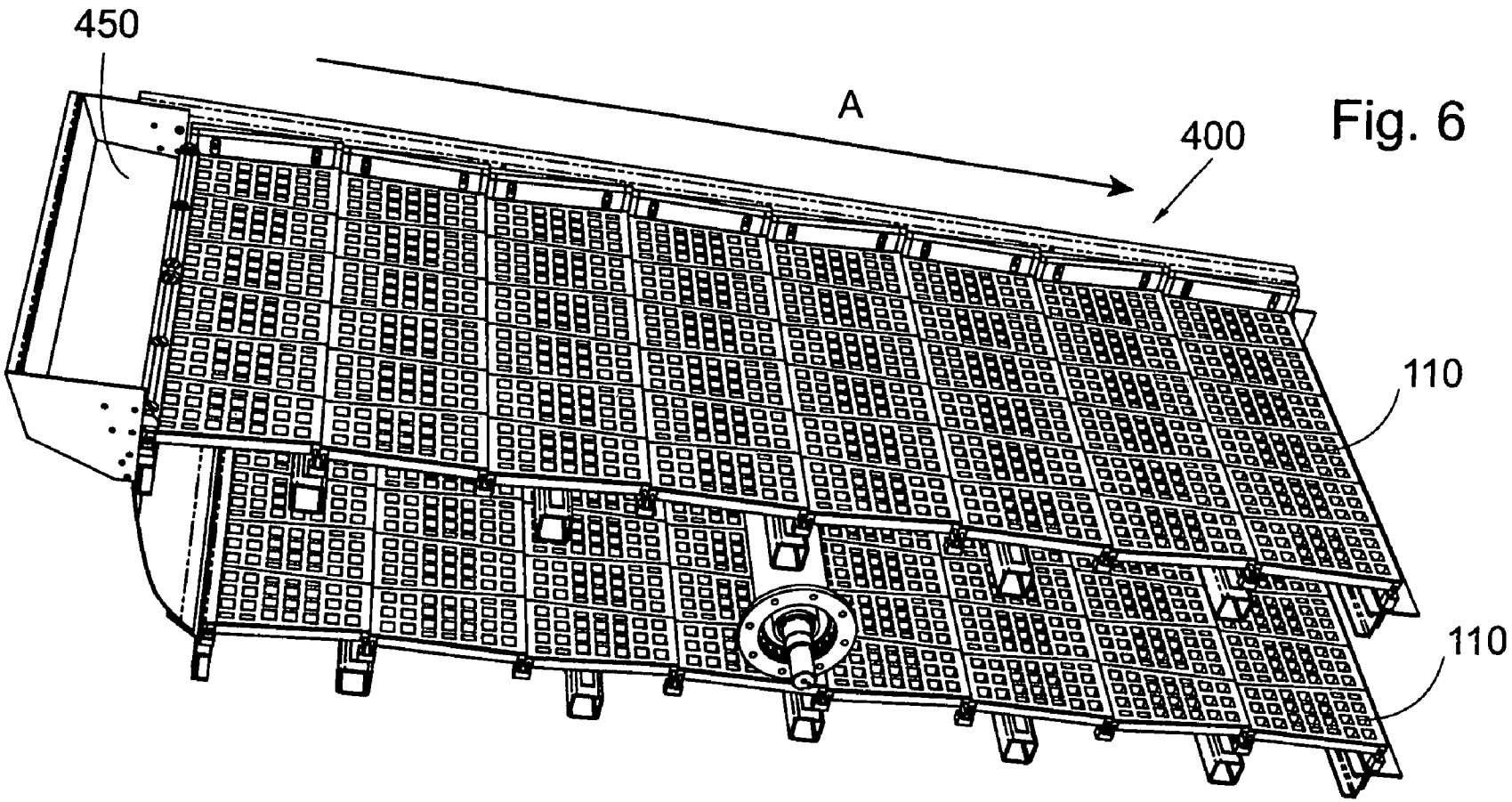
FIG. 6 is a schematic perspective assembly view of a screening arrangement having an external feeding box.

In FIG. 6 is, as earlier mentioned, a screening arrangement 400 shown having an external feeding box 450.

Figure 7:
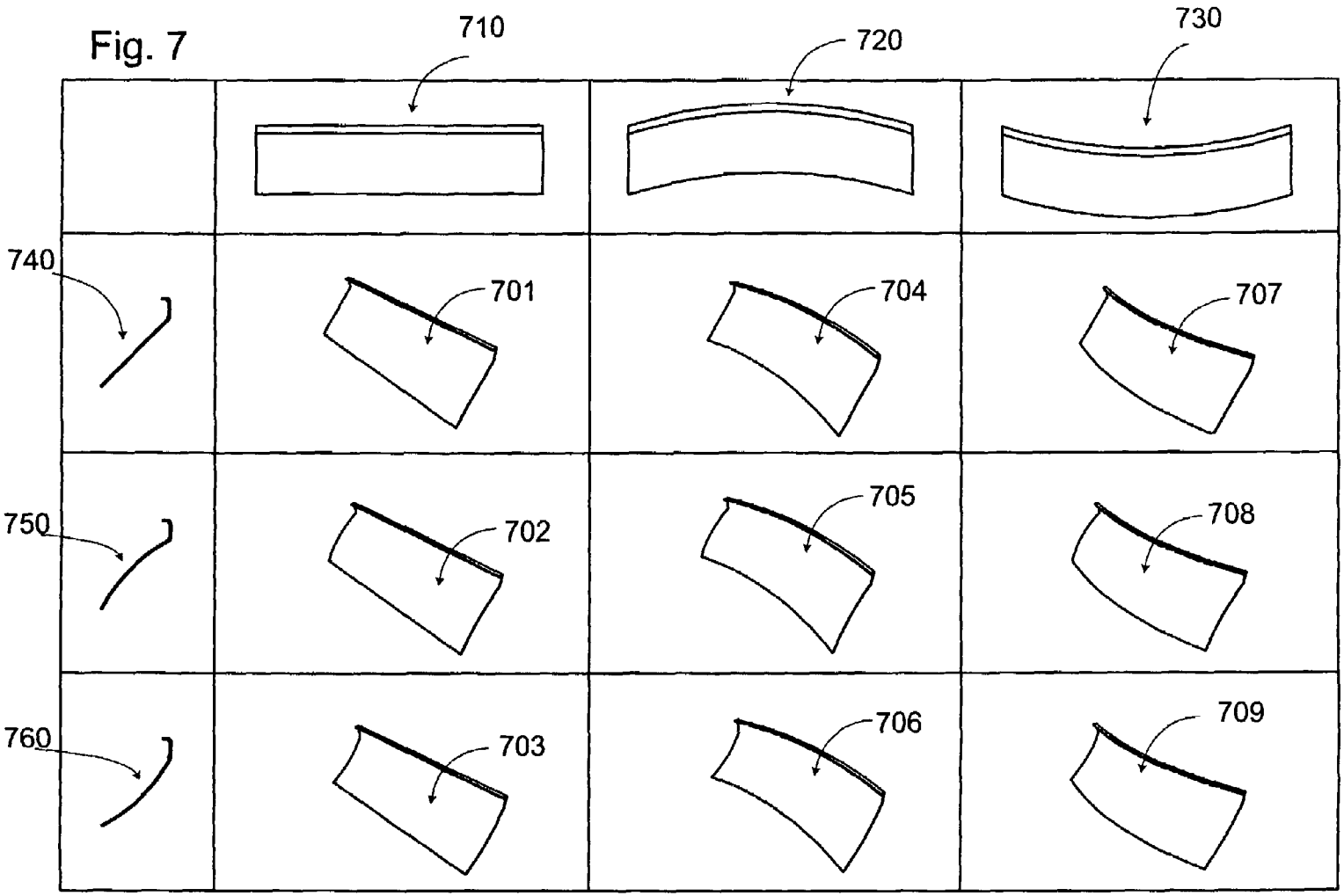
FIG. 7 is an overview of alternative configurations of the directing means.

To improve the directing functionality of the directing means 160, the directing plate 170 may be shaped or configured in different ways. In the overview of FIG. 7 different shapes 701-709 are shown. In the top horizontal row three alternative configurations, 710, 720 and 730 are shown. The first configuration 710 is a plane directing plate, the second configuration 720 is a positively curved directing plate having the central portion curved inwards and the third configuration 720 is a negatively curved directing plate, having the central portion curved outwards. In the second top row the cross-section 740 of the configurations 710, 720 and 730 is substantially straight. In the third top row the cross-section 750 of the configurations 710, 720 and 730 is curved outwards, negatively curved, and in the bottom row the cross-section 760 of the configurations 710, 720 and 730 is curved inwards, positively curved. The different variations 704-706 of the configuration 720 will essentially gather material that falls onto the directing plate 170 having any of these variations 704-706 to the middle portion of the directing plate 170 before it falls onto the below located screening deck 110. The different variations 707-709 of the configuration 730 will essentially disperse material that falls onto the directing plate 170 having any of these variations 707-709 before it falls onto the below located screening deck 110. There are in total nine different possible variations 701-709 of configurations of the directing plate 170 according the overview of FIG. 7.

Figure 8:
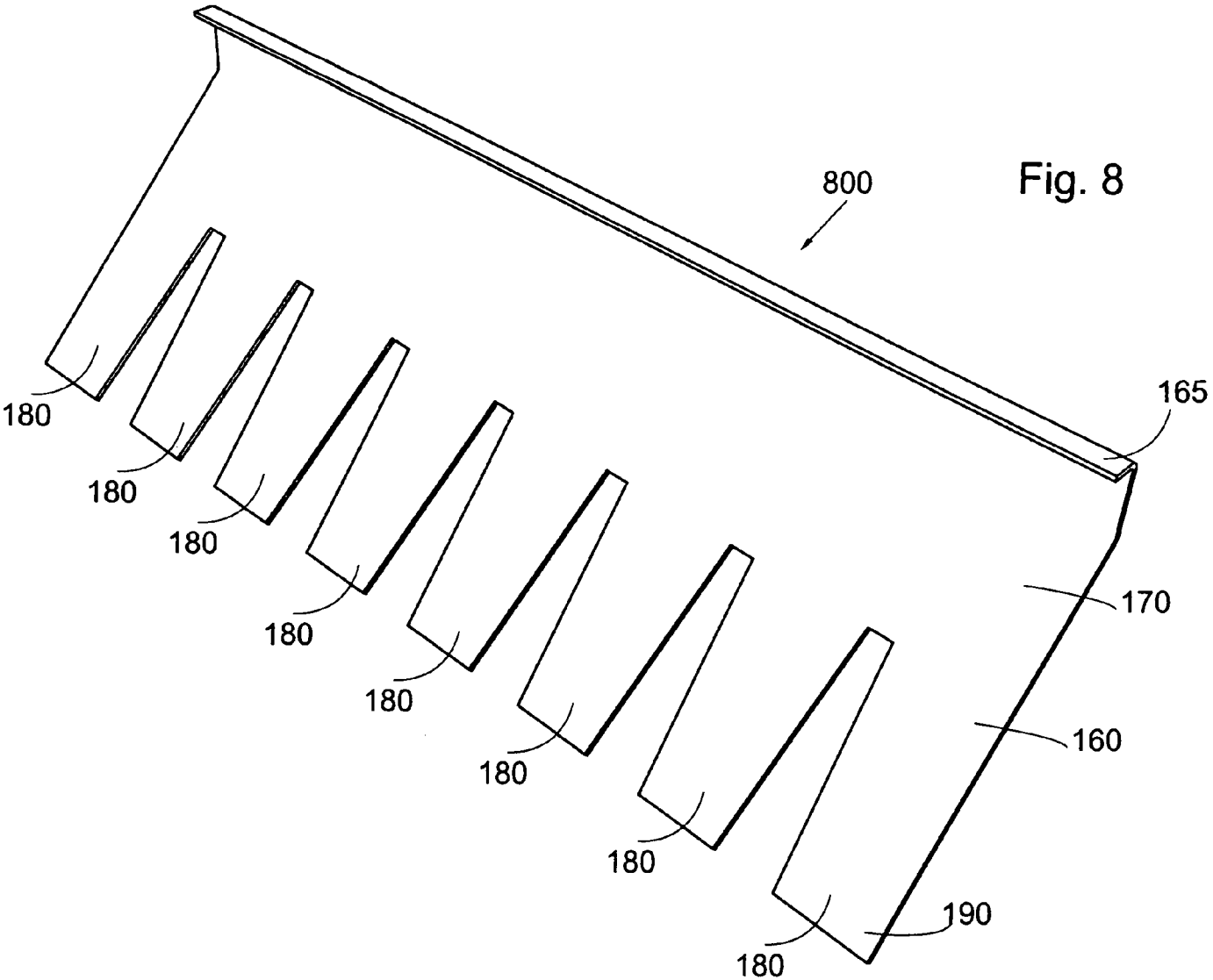
FIG. 8 is a perspective view of yet another alternative configuration of the directing means on the screening arrangement.

In FIG. 8 yet another configuration 800 of the directing plate 170 is shown, where the directing plate 170 is provided with spaced tongues 180 in the end portion 190 of the directing plate 170. In FIG. 8 the configuration of the directing plate 170 is substantially plane, but it can also be positively or negatively curved as with the configurations 701-709.

The directing plates 170 can also be provided with guiding raised sections on the surface to direct the material laterally, to either gather or disperse the material onto the below located screening deck.

The screening arrangement 100 can comprise screening decks 110 provided with directing plates 170 that are of the same configuration. The screening decks 110 can also be provided with a mixture of directing plates 170 of different configuration to achieve different effects at different positions in the screening arrangement 100. One example could be a screening arrangement having three screening decks, where the upper screening deck is provided with directing plates 170 having a shaping that disperse the material, the middle screening deck being provided with directing plates 170 having a substantially straight or plain shaping and where the lower screening deck is provided with directing plates 170 having a shaping that gather the material.

Another possible solution is a screening arrangement, where not every screening deck is provided with a screening arrangement, e.g. only the two upper screening decks in a screening arrangement having three screening decks. Yet another possible solution could be a screening arrangement, where only a part of the screening deck is provided with directing plates, e.g. the first part of the screening deck, relative to the traveling direction A of the material, or only the last part of the screening deck.

The function of directing means of the screening arrangement is as follows: material to be screened enters the screening arrangement 100 at feeding box 150 on the upper screening deck 110. The material starts to travel on the screening deck 110 along the longitudinal direction A of the screening arrangement 100. As material is screened, i.e. passes through holes of the screening elements 120 that forms the screening deck 110, the material falls onto the directing plates 170 that moves or directs the material so that it falls further up on the below located screening deck 110 than if gravity entirely should control the fall of the material from the upper screening deck 110 to the lower screening deck 110. Thus, the traveling path of the material on the lower screening will be longer and resulting in a better efficiency of the screening arrangement 100 and also enabling an efficient screening although the screening decks are not very long.

If the screening arrangement 100 comprises more than two screening decks 110 as the screening arrangement 300 of FIGS. 4 and 5, the process of directing material up streams between the screening decks, by the directing means 170, is repeated.

It is assumed that the term screening deck covers both a screening surface comprising screening elements and a screening surface comprising cross or longitudinally tensioned screening media. It is also assumed that the term plate covers a directing means made of any of the specified materials.

Although the present invention has been described in connection with preferred embodiments thereof, it will be appreciated by those skilled in the art that additions, deletions, modifications, and substitutions not specifically described may be made without department from the spirit and scope of the invention as defined in the appended claims. Further, the invention should not be limited to the shown embodiment; several modifications within the scope of the appended claims are possible.

What is claimed is:

1. A screening arrangement in a vibrating screen for screening of material, the screening arrangement comprising:

two or more screening decks placed at different heights; and

A plurality of directing means, wherein the A plurality of directing means are provided on an underside of at least two upper screening decks to direct screened material upstream onto a screening deck located below the at least one upper screening deck, and wherein substantially all material being screened on each screening deck travels in only one longitudinal direction, and wherein the directing means includes a plurality of spaced tongues in an end portion of the directing means.

2. A screening arrangement according to claim 1, wherein the directing means are arranged transversally with respect to a longitudinal direction of the screening deck.

3. A screening arrangement according to claim 1, wherein the directing means are obliquely arranged in relation to a longitudinal direction of the screening deck.

4. A screening arrangement according to claim 3, wherein an angle $\alpha$ is formed between the longitudinal direction of the screening deck and an extension of the directing means.

5. A screening arrangement according to claim 4, wherein the angle $\alpha$ is 20-80 degrees.

6. A screening arrangement according to claim 1, wherein the directing means extended over a total width of the screening deck.

7. A screening arrangement according to claim 1, wherein the directing means comprise a plane surface.

8. A screening arrangement according to claim 7, wherein the directing means comprise a curved surface.

9. A screening arrangement according to claim 8, wherein the curved surface of the directing means is positively curved.

10. A screening arrangement according to claim 8, wherein the curved surface of the directing means is negatively curved.

11. A screening arrangement according to claim 1, wherein the directing means and the screening deck are made of the same material.

12. A screening arrangement according to claim 11, wherein the directing means is made of a polymer material, a ceramic, a steel, or any combinations thereof.

13. A screening arrangement according to claim 1, wherein the directing means is made of a different material than the screening deck.

14. A screening arrangement according to claim 13, wherein the directing means is made of a polymer material, a ceramic, a steel, or any combinations thereof.

15. A screening arrangement according to claim 1, wherein the screening arrangement comprises a plurality of directing means arranged on the underside of at least one screening deck.

16. A screening arrangement according to claim 15, wherein the directing means arranged on the underside of the screening deck has the same shape on all screening decks.

17. A screening arrangement according to claim 14, wherein the directing means arranged on the underside of the screening deck has different shapes.

18. A screening arrangement according to claim 17, wherein the different shaping are alternately arranged on the underside of the screening deck.

19. A screening arrangement according to claim 1, wherein the screened material is crushed stone or gravel.

20. A screening arrangement according to claim 1, wherein the directing means comprise a curved surface.

21. A screening arrangement according to claim 1, wherein the curved surface of the directing means is positively curved.

22. A screening arrangement according to claim 1, wherein the curved surface of the directing means is negatively curved.

23. A screening arrangement in a vibrating screen for screening of material, the screening arrangement comprising:

two or more screening decks placed at different heights; and

A plurality of directing means, wherein the A plurality of directing means are provided on an underside of at least two upper screening decks to direct screened material upstream onto a screening deck located below the at least one upper screening deck, and wherein the directing means includes a plurality of spaced tongues in an end portion of the directing means.

* * * * *